US005077851A

United States Patent [19]

Guma

[11] Patent Number: 5,077,851

[45] Date of Patent: Jan. 7, 1992

[54] METHOD AND APPARATUS FOR TREATING CORDED FABRICS

[76] Inventor: Juan M. Guma, 08640 Olesa De Montserrat, Barcelona, Spain

[21] Appl. No.: 484,358

[22] Filed: Feb. 22, 1990

[30] Foreign Application Priority Data

Feb. 27, 1989 [ES] Spain ..... 8900692
Feb. 19, 1990 [ES] Spain ..... 9000475

[51] Int. Cl.[5] ..... D06B 3/28

[52] U.S. Cl. ..... 8/152; 68/62; 68/178

[58] Field of Search ..... 68/177, 178, 62, 18 C; 8/152; 417/423.1

[56] References Cited

U.S. PATENT DOCUMENTS

| | | | |
|---|---|---|---|
| 3,116,625 | 1/1964 | Stewart | 68/18 C X |
| 3,301,026 | 1/1967 | Mason et al. | 68/177 |
| 3,676,014 | 7/1972 | Bevan et al. | 417/423.1 X |
| 3,872,693 | 3/1975 | Cashen et al. | 68/18 C X |
| 3,894,411 | 7/1975 | Stanway | 68/62 X |
| 3,901,055 | 8/1975 | Broadbent | 68/178 X |
| 3,977,218 | 8/1976 | Zucchini | 68/18 C X |
| 4,023,385 | 5/1977 | Hurd | 68/62 |
| 4,340,986 | 7/1982 | Sturkey | 8/152 |
| 4,360,937 | 11/1982 | Putnam | 68/62 X |
| 4,536,907 | 8/1985 | Zumbrunn et al. | 68/178 X |

FOREIGN PATENT DOCUMENTS 2445211 4/1976 Fed. Rep. of Germany ..... 68/18 C

*Primary Examiner*—William A. Cuchlinski, Jr.
*Assistant Examiner*—G. Bradley Bennett
*Attorney, Agent, or Firm*—Steinberg & Raskin

[57] ABSTRACT

The procedure consists essentially of causing the corded fabric (4) to circulate in a continuous manner through a bath (3) of treatment liquid, and is characterized by the fact that the fabric (4) is subjected simultaneously to injection and spraying of the treatment bath liquid (3), by means of mixing air with the liquid, which separates into microparticles, the intake of the bath being effected from different points and at low pressure. The device comprises a substantially circular chamber (1), means (5) for the pulling of the fabric, with the fabric (4) circulating through a passageway defined between an outer plate (6) located next to the wall of the chamber (2) and an inner plate (7), and is characterized by the fact that it comprises a plurality of points (9, 10, 11, 12) of injection and spraying of the bath liquid along the entire run of the fabric (4) in the chamber (1). The plates (6, 7) form a spout (8) which facilitates the movement of the fabric (4). It also includes a grid (13) which permits better draining of the fabric (4). The dye is applied in a homogeneous manner.

17 Claims, 3 Drawing Sheets

METHOD AND APPARATUS FOR TREATING CORDED FABRICS

BACKGROUND OF THE INVENTION

The present invention refers to a method for treating corded fabrics, especially for the dyeing of fabrics, by means of which procedure the performance to the bath is increased and the dyeing of the fabric is improved.

The present invention also refers to an apparatus for carrying out the aforementioned procedure.

There exist known methods for treating corded fabrics, which consist essentially of causing the corded fabric to circulate in a continuous manner through a treatment bath and in subjecting it simultaneously to a stream of vaporized liquid in the initial zone of the run of the fabric.

The known apparatuses comprise a substantially circular chamber, in whose lower part there is found a treatment bath for the fabric, means for the continuous pulling of the fabric provided in the upper part of the chamber, and means for vaporizing of the liquid in the initial zone of the run of the fabric, with the fabric circulating through a passageway in the form substantially of a circular crown defined between an outer plate located next to the chamber wall and an inner plate.

The corded fabric is a continuous fabric that is placed along the aforementioned circular crown and is moved continuously by a shaft or ratchet located in the upper part of the device.

The bath occupies the lower part of the device and the fabric circulates in a continuous manner through the bath, becoming impregnated with the treatment liquid, generally dye. The corded fabric simultaneously receives the stream of vaporized liquid. After the fabric has been impregnated with the liquid, it is drained off at the bottom of the chamber, generally through the lateral walls that are provided with openings.

The stream of vaporized liquid distributes the liquid over the fabric and assists moving the fabric.

The prior art method and apparatus make it possible to effect the dyeing under generally acceptable conditions, but present some limitations, among which the following stand out:

- the distribution of the liquid by simple spraying is not optimum.
- the passageway defined by the outer and inner plates is not sufficient to prevent the formation of knots or similar results.
- the draining effected by the lateral walls is limited.
- contact with the bottom of the chamber causes rubbing which interferes with the travel of the fabric.
- because there is no control of the liquid's viscosity, there can be produced agglomerations of colorant which lead to strains on the fabric.

SUMMARY OF THE INVENTION

With the method and apparatus of the invention, climination of the aforementioned difficulties is obtained, providing other advantages which will be described.

The method for treating corded fabrics is characterized by the fact that the fabric is subjected simultaneously to injection and spraying of the treatment bath liquid, by means of a mixture of air with the liquid which separates into microparticles, which spray is applied throughout the entire run of the fabric, the intake of the bath being accomplished from various points and at low pressure, obtaining thereby a stable and uniform treatment with a minimum amount of bath.

The apparatus for treating corded fabrics, also an object of the present invention, is characterized by the fact that it comprises a plurality of points of injection and spraying of the bath liquid along the entire run of the fabric in the chamber, which spray is obtained by mixing air with the liquid, which separates into microparticles.

These microparticles are distributed directly onto the fabric, which makes it possible:

- to lower the viscosity of the dye bath even with dark colors where the amount of colorant is highly concentrated.
- to increase the penetration of the dye bath.
- to increase considerably the points of contact.
- to facilitate a perfect equalizing of the dye, even in the case of accelerated dyeing.

Advantageously, the outer and inner plates which define the passageway through which the fabric passes and which remain essentially parallel throughout the entire run of the fabric, come together in the initial zone of the run, forming a spout which facilitates the movement of the fabric, thus avoiding the formation of knots, even at elevated speeds up to 400–500 m/min.

The plurality of spraying points comprises the following: a first spraying point in the initial zone before the spout (injector over-flow), a second spraying point in the zone of the spout, a third point or spherical center, located in the central zone of the area defined by the inner plate and a fourth point located in the receiving zone of the fabric.

The above-mentioned spherical center makes it possible to effect a total cleaning following the dyeing and with reduced time, due to its high radius of action.

It also comprises a grid, formed by a plurality of bars or tubes of an essentially circular outer section, placed over the outer plate at the bottom of the chamber, which grid facilitates contact between the bath and the fabric, the self-expressing (wringing) of the fabric and the travel of the fabric thereon.

Thanks to these advantages of the grid, it is possible to reduce the ratio of the dye bath to ½ to ⅓ of the ratio for prior art apparatuses. With the self-expressing there is facilitated a better penetration of the dye bath which considerably increases the points of contact. On obtaining a natural (unforced) recirculation of the bath, the fabric is better impregnated without needing to be submerged in a static bath, no matter how abundant, which makes it possible to reduce the volume of the bath.

The utilization of washing formulae makes it possible to determine:

- The precise number of washes for obtaining a specific effect.
- The final concentration of some products according to the number of washes.
- The proper bath ratios for obtaining a low number of washes.

The base of the formulas is in the exponential expression:

$$Cn = \frac{Co}{\left(1 + \frac{a\,n}{nb}\right)}$$

where

Cn = final concentration

Co=initial concentration a 32 total water for washing b=water retained per Kg of textile material n=number of washings or portions of a washing From this there can easily be deduced the expression:

$$Cn = Co\left(\frac{r\ \%\ n}{100}\right)$$

in which r %=the percentage of change of bath per water.

From this latter formula there is deduced the basic formula of the discontinuous washing $$Ch = Co\left(\frac{2\ n}{B}\right)$$

where

B=liters of bath per Kg. of material treated.

In this formula n would be:

$$n = \frac{\log Cn}{\log 2} = \frac{\log Co}{\log B}$$

Another characteristic of the invention is that the apparatuses include a plurality of intake openings at the bottom of the chamber, in such arrangement that the circulation of the liquid through the grid forms arcs around the bars or tubes that distribute the particles in every direction.

It also includes a helical pump which produces high flow and low pressure, facilitating thereby the homogenization of the bath liquid. There is obtained a bath flow circulation of 500,000 l/h at a very low pressure on the order of 0.2 bar.

Advantageously, it includes means of control of the bath liquid's viscosity, so as to avoid massive agglomerations of colorant particles. In the case of disperse colorants, it involves maintaining good dispersion of the colorant even when dealing with large-molecule disperse elements.

The means of viscosity control facilitate even more the vaporizing of the liquid, forming an atmosphere of air/bath and gas.

Even though the procedure and device of the invention make it possible to work with ½ or ⅓ bath ratios, it is possible to work normally with a bath ratio of from 1/5 up.

With the device of the invention there is obtained:

high velocity: with double cord, fabric velocity of 2,000 meters in three minutes low bath ratio: 400 bath renewals per hour=6.6 renewals per minute high flow 6.6 (renewals per minute) at low pressure.

It therefore involves a new concept in the dyeing procedure.

The device of the invention comprises a closed distillation circuit connected to the chamber, which includes a distillation column connected at the upper part of the chamber, a condensation device and a receptacle for collection of the products of condensation and of oil separation, connected in turn at the lower part of the chamber, which circuit allows the recovery of solvents from the treatment liquid.

It also comprises a vacuum pump placed in at least one of the outlets of the intake openings so as to reduce the presence of the bath liquid in the fabric. There is thus obtained a better draining thereof.

Finally, the chamber of the device includes a plurality of reinforcing rings to withstand the vacuum within it.

BRIEF DESCRIPTION OF THE DRAWING

For a better understanding of all that has been set forth, there are attached some drawings in which, schematically and only as non-limitative examples, there are represented preferred embodiments In these drawings.

DESCRIPTION OF THE PREFERRED EMBODIMENTS

Figure 1:
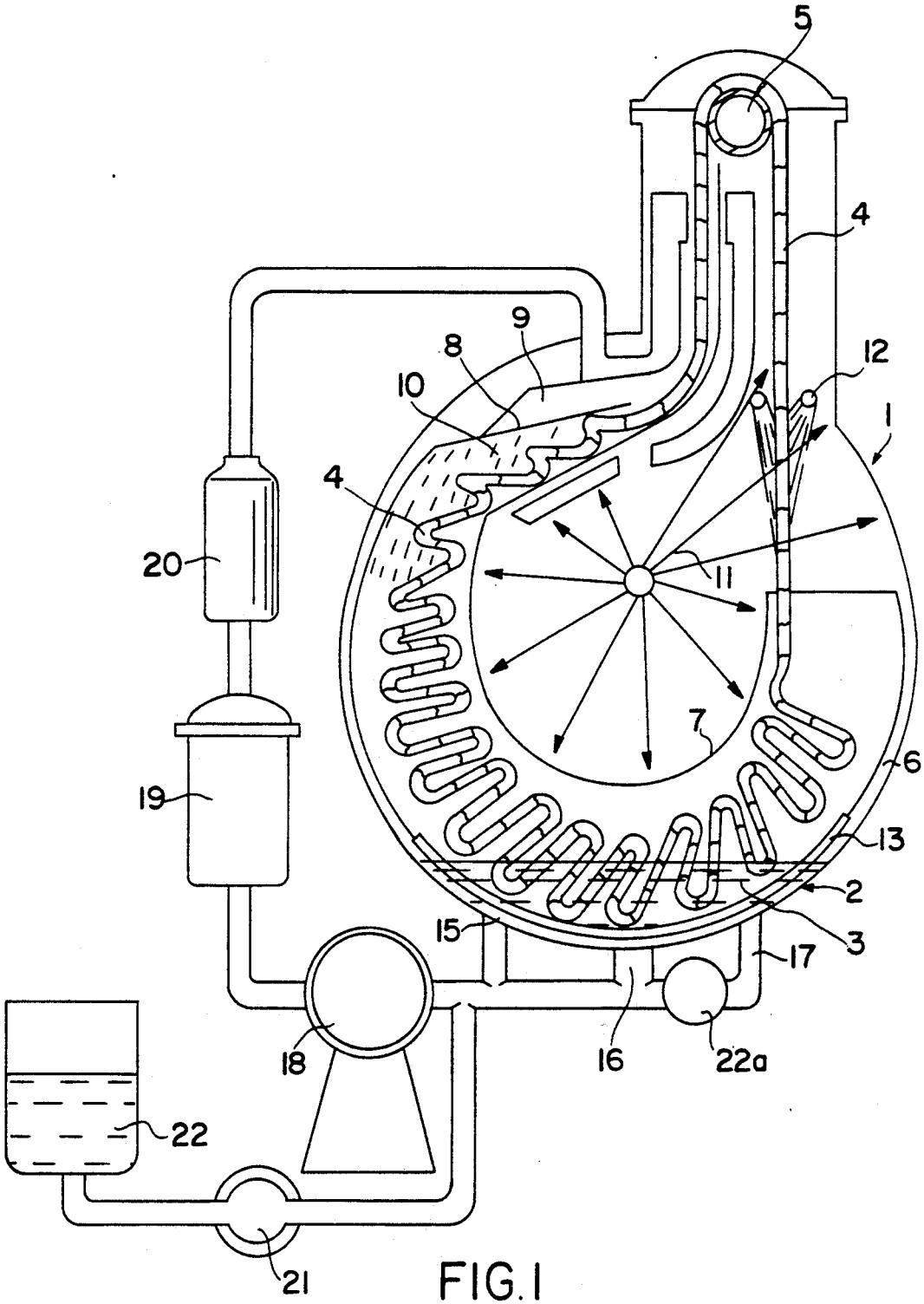
FIG. 1 is a sectional end view of the device of the invention.

As shown in FIG. 1, the device for treating corded fabrics of the invention comprises a substantially circular chamber, in whose lower part 2 there is a bath 3 of treatment of fabric 4, means 5 for the continuous pulling of the corded fabric 4, an outer plate 6 and an inner plate 7 which remain substantially parallel, thereby defining a passageway 8 through which the fabric 4 circulates.

As can be seen in FIG. 1, these two plates 6, 7 converge in the initial zone of the run, forming thereby a spout 8 which facilitates the movement of the fabric 4, thus avoiding the formation of knots.

It also comprises a plurality of means for spraying the microparticles respectively at a first point 9 of spraying in the initial zone before the spout 8 (injection overflow), a second point having an injector 10 of spraying in the zone of the spout 8, a third point having an injector (spherical center) 11 located in the central zone of the area defined by the inner plate 70 and a fourth point element 17 located in the receiving zone of the fabric 4.

Figure 2:
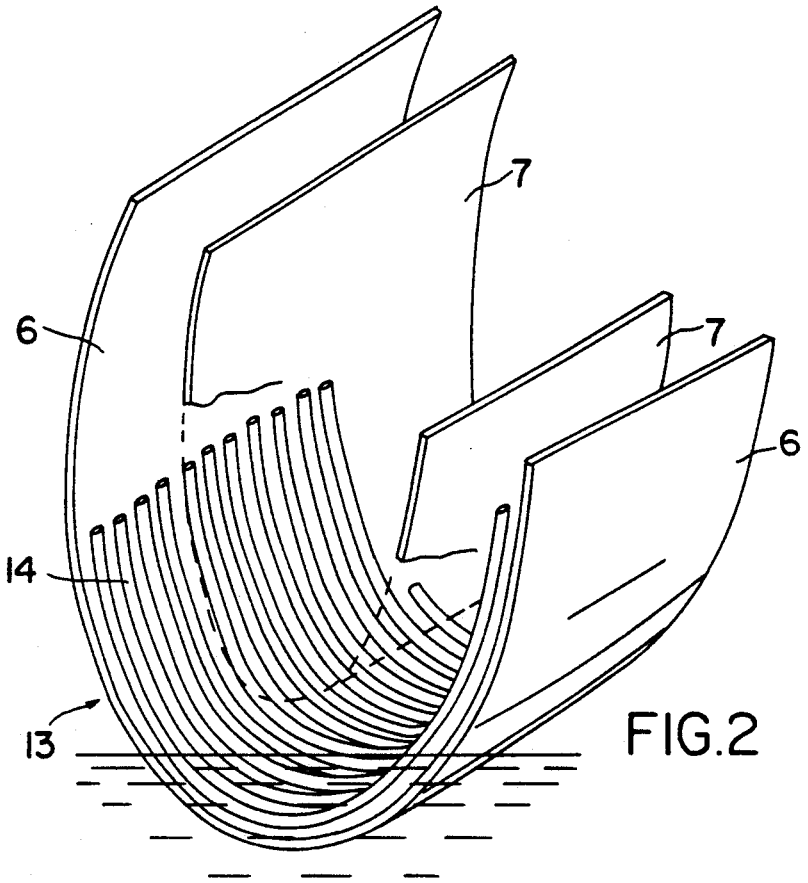
FIG. 2 is a detail of the outer and inner plates and of the grid at the bottom.

The device also includes a grid represented in detail in FIG. 2, formed by a plurality of tubes 14 located over the outer plate 6 at the bottom of the chamber 1.

Due to the round shape of the bars, the travel of the fabric 4 over the grid is facilitated at the same time the contact between the bath 3 and the fabric is facilitated.

Figure 3:
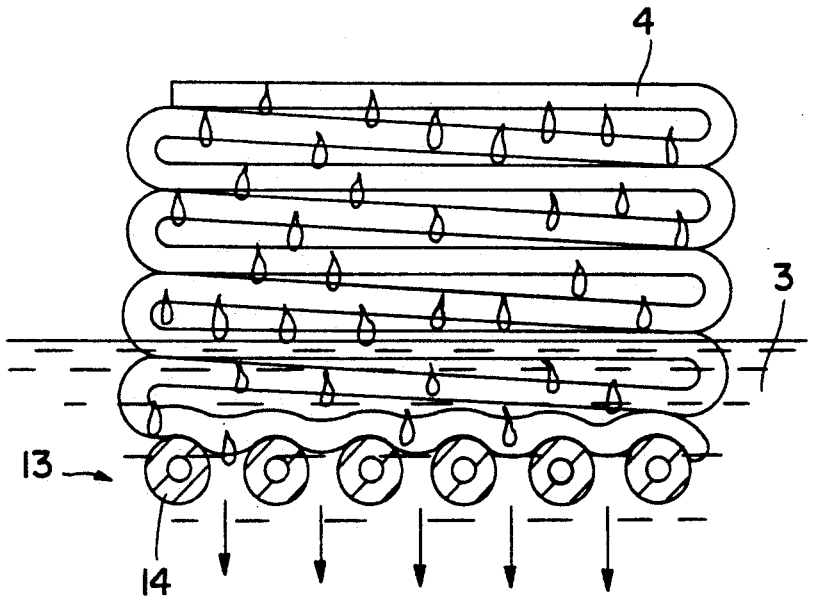
FIG. 3 is a sectional view of the aforementioned grid showing the self-expressing of the fabric.

As shown by FIG. 3, the grid facilitates self-expressing of the fabric 4, since, with the grid being located under the fabric, it is the latter's own weight which compresses it.

As shown in FIG. 1, the device of the invention comprises a plurality of intake openings 15, 16, 17 at the bottom of the chamber in such arrangement that the circulation of the liquid through the grid 13 forms arcs around the bars or tubes that distribute the particles in every direction.

In FIG. 1 there can be seen a helical pump 18, a filter 19 and an exchanger 20. The helical pump 28 produces an elevated flow and low pressure, facilitating the homogenization of the liquid of the bath 3. Connected to the openings 15, 16, 17 are an additional pump 21 and a preparation tank 22.

In the same Figure can also be seen a vacuum pump 22*a* located in at least one of the outlets of the intake openings 15, 16, 17—to reduce the presence of the bath liquid in the fabric.

Figure 4:
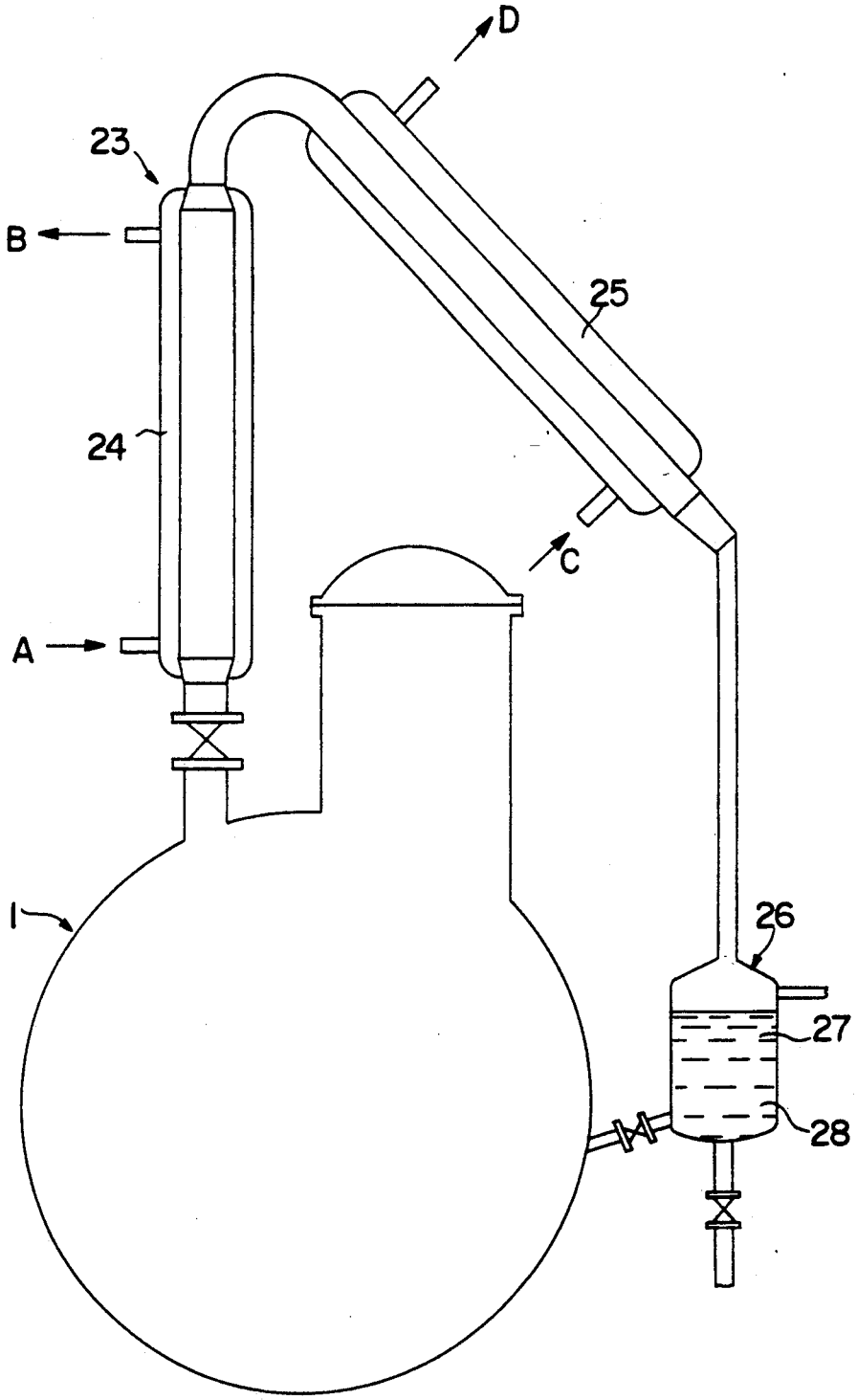
FIG. 4 shows the distillation circuit attached to the chamber of the device.

FIG. 4 shows a closed distillation circuit 23 connected to the chamber 1. This circuit 23 comprises a distillation column 24 connected at the upper part of the chamber 1, a condensation device 25, and a receptacle 26 for collection of the products of condensation and of oil separation, connected in turn at the lower part of the chamber 1.

This circuit serves for the recovery of solvents from the treatment liquid. The most volatile components of the dye evaporate in the distillation column 24, around which steam is caused to pass in the direction of arrows A and B, and condense in the condensation device 25, around which cold water is caused to circulate in the direction of arrows C and D.

The condensates are collected in the receptacle where the solvents are separated from the oil or grease that is deposited in the upper part 27, with the solvents remaining in the lower part 28 from which there goes out a passageway 29 of connection to the chamber 1.

The description set forth above pertains to a concrete embodiment of the invention, but there are understood to be included within the scope thereof all the possible variants accessible to a person skilled in the art.

What is claimed is:

1. An apparatus for treating a corded fabric comprising;

a chamber;

a bath of treatment liquid within said chamber;

means mounted within said chamber for continuously pulling said corded fabric;

an inner plate and an outer plate, said inner plate and outer plate mounted within said chamber and together forming a passageway constituting a run through which said corded fabric can be continuously circulated; and a plurality of means for respectively spraying said corded microparticles formed by said treatment liquid having been mixed with air at a plurality of points within said chamber wherein said means for spraying comprise an overflow injector located adjacent said initial zone of said run, another injector located within said initial zone, still another injector located substantially at a point equidistant from an inner surface of said inner plate, and a shower element located in a receiving zone for said fabric.

2. The apparatus of claim 1, wherein said inner plate and said outer plate are located so as to be substantially parallel to each other throughout most of the run of said corded fabric but converge at an initial zone of said run to form thereby a spout which facilitates movement of said fabric such that the possibility of knot formation in said corded fabric is reduced.

3. The apparatus of claim 1, further comprising a closed distillation circuit connected to said chamber, said closed distillation circuit comprising a distillation column connected to said chamber, a condensation device connected to said distillation column, and a receptacle connected to said condensation device and directly to said chamber, said circuit functioning to enable the recovery of solvents from said bath of treatment liquid.

4. The apparatus of claim 1, further comprising means for controlling the viscosity of said bath of treatment liquid such that agglomerations of colorant particles therein are substantially avoided.

5. The apparatus of claim 1, further comprising means for controlling the viscosity of said bath of treatment liquid such that agglomerations of colorant particles therein are substantially avoided.

6. The apparatus of claim 1, further comprising a closed distillation circuit connected to said chamber, said closed distillation circuit comprising a distillation column connected to said chamber, a condensation device connected to said distillation column, and a receptacle connected to said condensation device and directly to said chamber, said circuit functioning to enable the recovery of solvents from said bath of treatment liquid.

7. The apparatus of claim 1, further comprising a grid formed by a plurality of bars on tubes, said grid abutting said outer plate so as to facilitate contact between said bath and said corded fabric, to facilitate self-expressing of said corded fabric, and to facilitate movement of said corded fabric.

8. The apparatus of claim 7, wherein said chamber comprises a plurality of openings in such arrangement that circulation of said treatment liquid through said grid forms arcs around said bars or tubes such that said microparticles are sprayed in a plurality of directions.

9. The apparatus of claim 8, further comprising a vacuum pump connected to at least one of said plurality of openings and functioning to remove said treatment liquid from said fabric.

10. The apparatus of claim 9, further comprising one or more reinforcing rings mounted within said chamber to protect elements therein from a vacuum generated by said vacuum pump.

11. An apparatus for treating a corded fabric comprising:

a chamber;

a means for spraying treatment liquid within said chamber;

a bath of said treatment liquid within said chamber;

means mounted within said chamber for continuously pulling said corded fabric;

an inner plate and an outer plate, said inner plate and outer plate mounted within said chamber and together forming a passageway constituting a run through which said corded fabric can be continuously circulated;

wherein said inner plate and said outer plate are located so as to be substantially parallel to each other throughout most of the run of said corded fabric but converge at an initial zone of said run to form thereby a spout which facilitates movement of said fabric such that the possibility of knot formation in said corded fabric is reduced;

wherein said means for spraying comprise an overflow injector located adjacent said initial zone of said run, another injector located within said initial zone, still another injector located substantially at a point equidistant from an inner surface of said inner plate, and a shower element located in a receiving zone for said fabric.

12. The apparatus of claim 11, further comprising means for controlling the viscosity of said bath of treatment liquid such that agglomerations of colorant particles therein are substantially avoided.

13. The apparatus of claim 11, further comprising a closed distillation circuit connected to said chamber, said closed distillation circuit comprising a distillation column connected to said chamber, a condensation device connected to said distillation column, and a receptacle connected to said condensation device and directly to said chamber, said circuit functioning to enable the recovery of solvents from said bath of treatment liquid.

14. The apparatus of claim 11, further comprising a grid formed by a plurality of bars on tubes, said grid abutting said outer plate so as to facilitate contact between said bath and said corded fabric, to facilitate self-expressing of said corded fabric, and to facilitate movement of said corded fabric.

15. The apparatus of claim 14, wherein said chamber comprises a plurality of openings in such arrangement that circulation of said treatment liquid through said grid forms arcs around said bars or tubes such that said microparticles are sprayed in a plurality of directions.

16. The apparatus of claim 15, further comprising a vacuum pump connected to at least one of said plurality of openings and functioning to remove said treatment liquid from said fabric.

17. The apparatus of claim 16, further comprising one or more reinforcing rings mounted within said chamber to protect elements therein from a vacuum generated by said vacuum pump.

* * * * *